United States Patent [19]

Witty et al.

[11] Patent Number: 4,913,352

[45] Date of Patent: Apr. 3, 1990

[54] GRIT PROTECTED PRESSURE REGULATOR FOR POP-UP SPRINKLERS

[75] Inventors: Michael E. Witty, West Covina; Steven Verbera, Azusa, both of Calif.

[73] Assignee: Rain Bird Consumer Products Mfg. Corp., Glendora, Calif.

[21] Appl. No.: 308,659

[22] Filed: Feb. 9, 1989

[51] Int. Cl.[4] ..... B05B 15/10

[52] U.S. Cl. ..... 239/104; 239/205; 239/570

[58] Field of Search ..... 239/104, 200, 201, 203, 239/204, 205, 570; 137/494, 497, 504

[56] References Cited

U.S. PATENT DOCUMENTS

| | | | |
|---|---|---|---|
| 3,948,285 | 4/1976 | Flynn | 239/570 |
| 4,078,726 | 3/1978 | Walto | 239/205 |
| 4,080,993 | 3/1978 | Lind, Jr. | 137/504 |
| 4,479,611 | 10/1984 | Galvis | 239/205 |
| 4,681,260 | 7/1987 | Cochran | 239/570 |
| 4,796,804 | 1/1989 | Weiss | 239/205 |

*Primary Examiner*—2

*Assistant Examiner*—Karen B. Merritt

*Attorney, Agent, or Firm*—Kelly, Bauersfeld & Lowry

[57] ABSTRACT

A pop-up irrigation sprinkler having a tubular pressure regulator mounted for movement in the pop-up stem and a funnel shaped grit protector shroud mounted within the stem above the pressure regulator to direct deleterious particulate matter downwardly through the pressure regulator.

10 Claims, 5 Drawing Sheets

FIG. 3
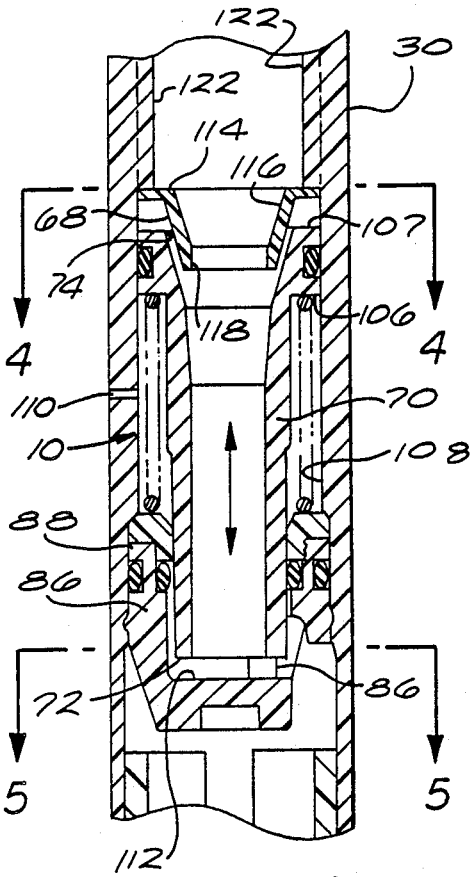
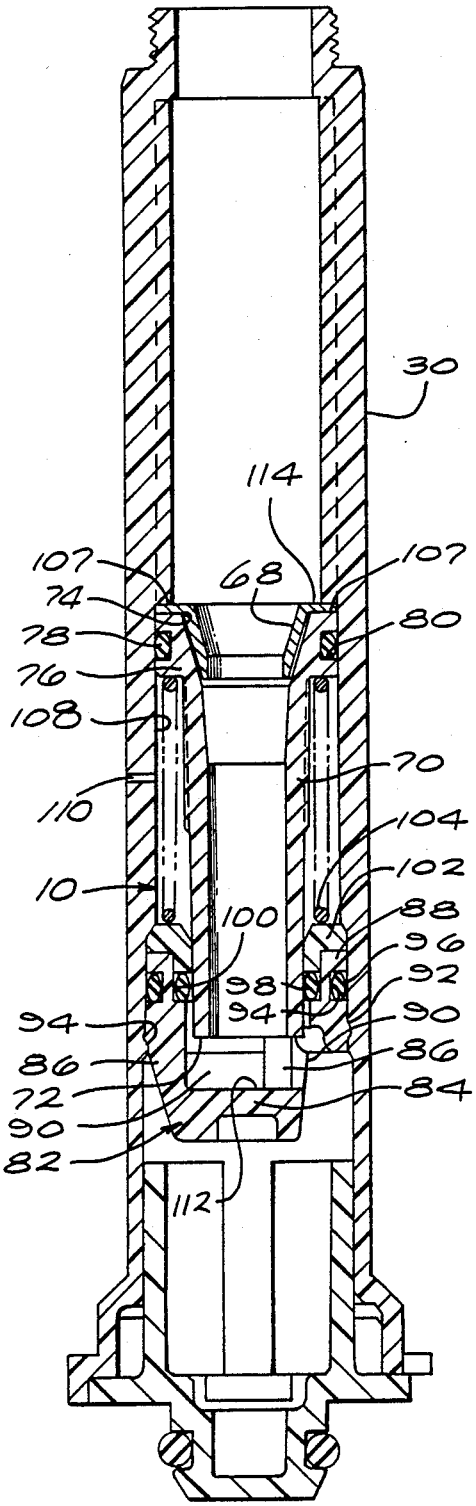
FIG. 2
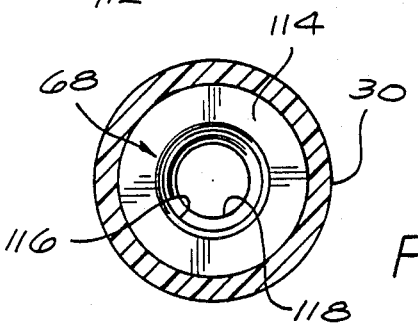
FIG. 4
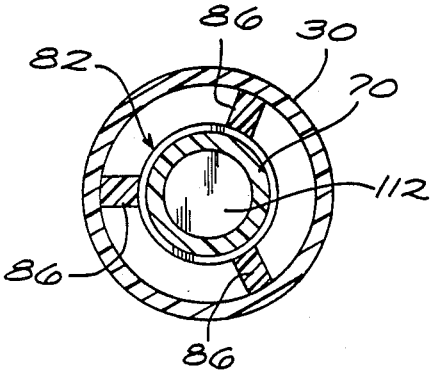
FIG. 5

GRIT PROTECTED PRESSURE REGULATOR FOR POP-UP SPRINKLERS

BACKGROUND OF THE INVENTION

This invention relates to pop-up irrigation sprinklers, and more particularly, to a new and improved grit protected pressure regulator used in the pop-up stem of such sprinklers.

It has been known in the art to employ with pop-up type irrigation sprinklers a pressure regulator in the pop-up stem of the sprinkler to control and keep constant the pressure at which water from the sprinkler nozzle is ejected into the atmosphere. The use of such pressure regulators is particularly useful with pop-up sprinklers which will be used where the source pressure supplied to the sprinkler may vary over wide ranges, such as typically found in residential applications or where the sprinklers are to be used in hilly terrain. By using a pressure regulator, the sprinkler nozzle will produce a spray pattern which will be substantially constant over a wide range of supply pressures, thereby assuring that optimum sprinkler performance is achieved even though the source pressure to the sprinkler may vary over wide ranges.

One such pressure regulator which has been suggested for use within the pop-up stem of pop-up sprinklers includes a flow seat secured within a lower portion of the stem, and a flow tube which is mounted within the stem for limited reciprocation above the seat. The flow tube, which is typically spring biased and centered within the stem by O-ring type seals disposed about the upper and lower end portions of the tube and which engage the inside sidewall of the stem to seal the space between the outside of the tube and the inside of the stem between the seals, raises and lowers relative to the seat to regulate the water from the source passing through the flow tube to the sprinkler nozzle in response to the inlet water pressure. By controlling the pressure to the nozzle through movement of the flow tube relative to the seat, a substantially constant water pressure at the nozzle can be maintained.

One problem that has been encountered with pressure regulators of this type mounted in the pop-up stem of a pop-up sprinkler is that grit, dirt, sand and other particulate matter carried by the supply water may cause the pressure regulator mechanism to jam and become inoperative. This is particularly true where the sprinkler is operated in sandy soil conditions, such as, for example, are frequently encounted in Florida and other areas where high concentrations of particulate matter may be found in the ground water supplies used for providing irrigation water.

When the water supply is shut off to the sprinkler after use, water will remain trapped within the stem as the stem retracts into the sprinkler housing. As the water drains down through the stem, or if the sprinkler is equipped with a low pressure shut off valve at the base, as is frequently the case and which results in water being permanently trapped within the stem until a new irrigation cycle is initiated, particulate material carried by or entrained within the water will settle out of the water and drop to the bottom of the stem. As the particulate material settles out of the water, it will settle and accumulate on any upwardly facing surfaces it encounters within the sprinkler. It has been found that frequently this will result in the accumulation of particulate material around the seals at the upper end of the flow tube and will cause the flow tube to jam or become clogged and hence, inoperative.

The present invention provides a means for protecting the seals and operating components of a flow tube type pressure regulator mounted in the stem of a pop-up sprinkler against the influx and accumulation of grit, sand, dirt and other particulate matter to prevent the pressure regulator mechanism from becoming jammed or made inoperative.

SUMMARY OF THE INVENTION

In accordance with the present invention, a grit protector means is provided within the stem of a pop-up sprinkler to prevent deleterious particulate material from accumulating around the upper end of the flow tube of a pressure regulator mounted within the stem after an irrigation cycle has been completed, thereby to prevent jamming and clogging of the operating mechanism of the pressure regulator. The use of the grit protector permits the pressure regulator to be reliably used in pop-up sprinklers even when used in extremely sandy and dirty water conditions, and operates in a highly reliable and effective manner to insure that jamming and clogging of the pressure regulator will not result.

The grit protector comprises a funnel shaped tubular member stationarily mounted within the stem above the flow tube and which has an enlarged diameter upper end converging downwardly to a smaller diameter lower end disposed to project into the upper end of the flow tube. The grit protector includes an enlarged diameter radial flange which is frictionally secured within the stem, and preferably is made of molded plastic material which will not corrode or deteriorate with use. The grit protector functions to deflect and funnel particulate material settling out of the water within the stem downwardly through the flow tube so as to prevent the accumulation of particulate material on the upper end of the flow tube and around its upper seals.

Other features and advantages of the invention will become apparent from the following detailed description taken in conjunction with the accompanying drawings which disclose, by way of example, the principles of the invention.

DETAILED DESCRIPTION OF THE DRAWINGS

FIG. 2 is a cross-sectional view similar to FIG. 1, but showing the pop-up stem of the sprinkler removed from the sprinkler housing;

FIG. 3 is a fragmentary cross-sectional view similar to FIG. 2, but showing the flow tube of the pressure regulator in an operative position;

FIG. 4 is a cross-sectional view taken substantially along line 4—4 of FIG. 3; and FIG. 5 is a cross-sectional view taken substantially along line 5—5 of FIG. 3.

DETAILED DESCRIPTION OF THE PREFERRED EMBODIMENT

Figure 1:
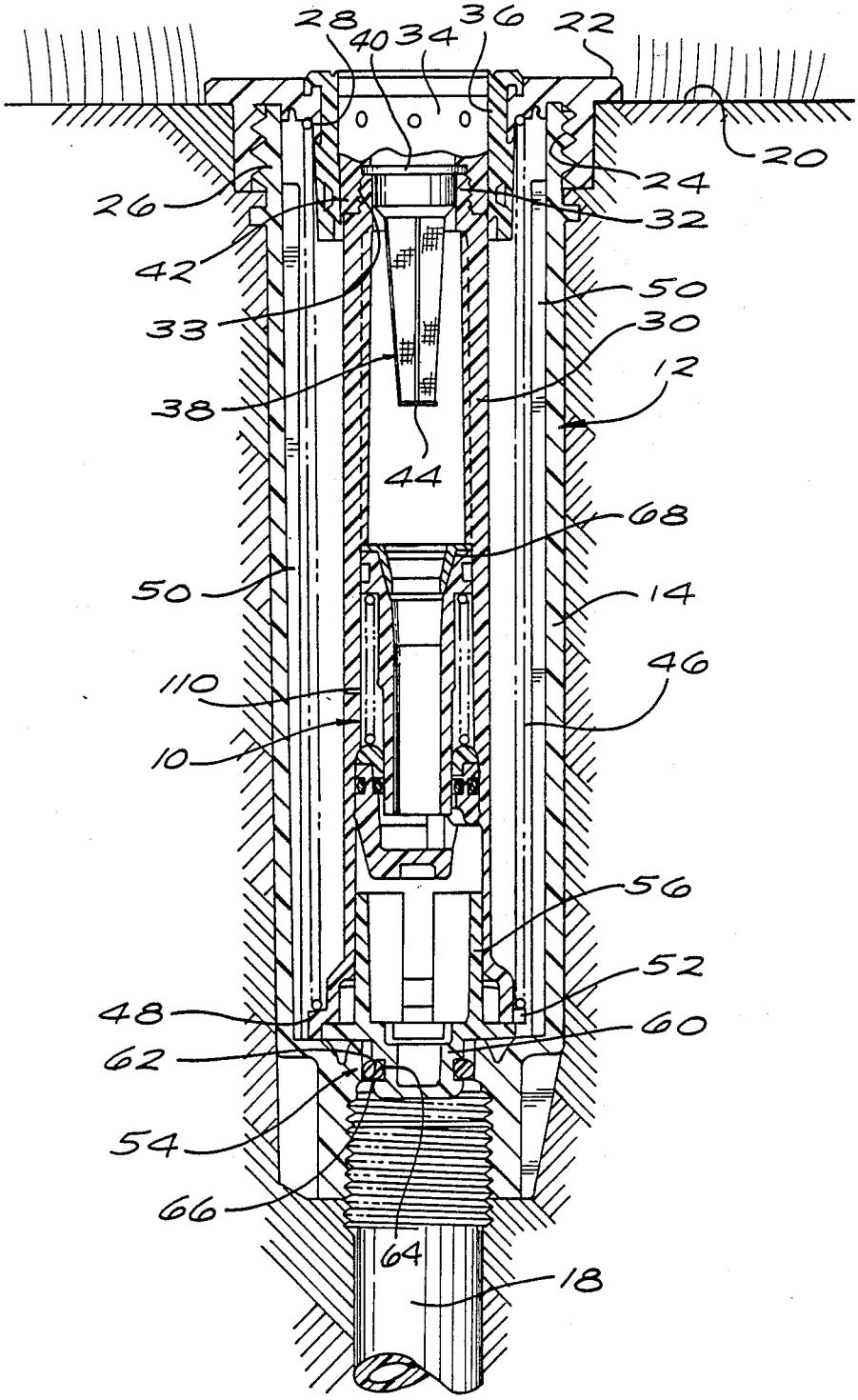
FIG. 1 is a vertical cross-sectional view of a pop-up irrigation sprinkler having a grit protected pressure regulator embodying the principles of the present invention, the sprinkler being shown in its retracted, inoperative position.

As shown in the exemplary drawings, the present invention is embodied in a grit-protected pressure regulator, generally designated by the reference numeral 10, for use in pop-up type irrigation sprinklers 12 of generally conventional design, such as of the type marketed by Rain Bird Sprinkler, Mfg. Corp. of Glendora, Calif., under model number 1800, as shown in pages 42, 43 of its 1987 Consumer Products Catalog. In this instance, the exemplary pop-up sprinkler 12 includes a sprinkler housing 14 having a generally upright cylindrical shape with an inlet fitting 16 at the lower end which can be internally threaded, as illustrated, for connection to a riser pipe 18 which is, in turn, coupled to a pressurized water supply line (not shown).

The sprinkler housing 14 is constructed typically by a high production molding or casting process, preferably from a relatively light weight molded plastic or the like, suitable for underground installation with the upper end disposed substantially flush with the surface of the soil 20, as illustrated in FIG. 1. The upper end of the housing 14 supports an annular cap 22 herein shown secured to the housing by interengaging sets of threads 24 and 26, and defining a central opening 28 through which an elongated, hollow cylindrical pop-up stem 30 is movable between a retracted position and an elevated spraying position. Secured to the upper end portion 32 of the pop-up stem 30, herein by a threaded connection 33, is a spray nozzle 34 for ejecting water outwardly from the sprinkler 12 when the pop-up stem is in the elevated spray position. Herein, an elongated annular seal 36 formed of flexible material such as rubber or soft plastic, and which may be of the type shown are described in U.S. Pat. No. 4,316,579 issued Feb. 23, 1982 entitled Multi-Purpose Seal For Pop-Up Sprinkler, is disposed within the central opening 28 of the cap 22, and engages the outer surface of the pop-up stem 30 to restrict passage of grit and other deleterious particulate material between the pop-up stem and the central opening in the cap, and to seal the pop-up stem with respect to the cap when in the elevated spraying position.

To filter particulate material entering the sprinkler 12 with the supply water, on elongated filter screen 38 is mounted in the upper end portion 32 of the stem 30 below the nozzle 34. Herein, the screen 38 includes a flange open top 40 clamped between the upper end of the stem 30 and a downwardly facing circumferential shoulder 42 formed in the nozzle above the threads 33, and a downwardly projected truncated conical screen-like body portions 44 extending into the stem. Water passing from the stem 30 to the nozzle 34 must flow through the screen-like body portion 44 which filters particulate material from the water before reaching the nozzle.

To bias the pop-up stem 30 toward the retracted position, a compression spring 46 is disposed about the stem within the housing 14 with its upper end engaging the under side of the cap 22 and its lower end engaging a radially enlarged flange 48 formed to project radially outwardly from the lower end of the stem. Preferably, the spring 46 is selected such that it will retain the stem 30 in the retracted position until a predetermined water supply pressure admitted through the riser pipe 18 is reached, typically about 30 pounds per square inch, at which time the water supply pressure acting on the stem will be sufficient to overcome the force of the spring and effect movement of the pop-up stem to the extended position. During movement of the stem 30 between the retracted and extended positions, the stem is restrained against rotation and guided by ribs 50 extending longitudinally along the inside surface of the housing 14, and which are slideably received within corresponding notches 52 formed in the flange 48 of the stem, as is conventional in pop-up sprinklers 12 of the type illustrated in FIG. 1.

The lower end of the stem 30 as shown herein is fitted with a control valve, generally designated 54, and which functions to seal the sprinkler housing 14 against inflow of water from the supply pipe 18 unless and until the water pressure reaches or exceeds a predetermined threshold pressure sufficient to move the stem against the action of the spring 46. When water pressure is below the predetermined threshold, the control valve 54 prevents leakage or drainage of water through the sprinkler housing 14, thereby preventing water waste in the form of localized flooding or over watering of the soil immediately surrounding the upper end of the housing, and, when the water supply is turned on and supply line water pressure increases, flow through the housing is prevented until the pressure builds to a sufficient level to force the stem 30 to extend against the bias of the spring 46 to the elevated spraying position.

As best seen in FIGS. 1 and 2, the control valve 54 herein is of the type illustrated and described in U.S. Pat. No. 4,479,611 issued Oct. 30, 1984 entitled Pop-Up Sprinkler and comprises a cylindrical valve body 56 which can be formed from a light weight and inexpensive molded plastic or the like, and is sized for reception into the lower end of the pop-up stem 30. The valve body 56 is secured to the stem 30 for movement therewith by any suitable technique, such as a friction fit or rise of an adhesive or the like, and includes vertically extending recesses 58 spaced about its periphery for cooperating with the stem to define open channels for passage of water upwardly into the hollow stem and ultimately to the nozzle 34.

Projecting downwardly from the valve body 56 is a central valve plug 60 of relatively small cross sectional area, and which is dimensioned to be received in a relatively small circular inlet port 62 formed in the inlet fitting 16 at the lower end of the housing 14. The valve plug 60 has a length sufficient to include a circumferential groove 64 for receiving a relatively small O-ring seal 66, which, when the stem is in the fully retracted position, effectively seals the inlet port 62 to the infow of water from the riser 18. Upon pressurization of the supply pipe and riser 18, when the water pressure reaches the predetermined threshold level, the stem 30 is forced upwardly by the action of water pressure on the valve plug 60. As the valve plug 60 rises out of the inlet port 62, water pressure then enters the lower end of the housing 14, thereby exposing the relatively large diameter flange portion 48 of the stem 30 to inlet pressure and causing the stem to rapidly move against the bias of the spring 46 from the retracted to the extended operational position.

In operation, with the stem 30 extended above the housing 14, water flowing through the stem to the nozzle 34 passes through the pressure regulator 10 which functions to regulate the pressure supplied to the nozzle so that a substantially constant pressure of inlet water enters the nozzle 34. By controlling the pressure at the nozzle 34, any given nozzle will operate to provide the same water distribution pattern regardless of the inlet water pressure, and also will permit a wide range of nozzle sizes to be operated at the same selected pressure level.

As can best be seen in FIGS. 2 and 3, the pressure regulator 10 is mounted within the lower end portion of the stem 30 above the large diameter flange 48 and below the filter screen 38, and includes an elongated, hollow flow tube 70 mounted for limited longitudinal movement within the stem. The flow tube 70 has a circular horizontal cross-section with an open lower end 72 and an open upper end 74, the upper end portion having a radially extending flange portion 76 dimensionsed to be slideably received within the inside of the stem 30. Herein, an O-ring seal 78 is disposed within an outwardly open groove 80 formed about the flange 76, and which functions to provide a water tight seal between the flange and the inside of the stem 30.

Stationarily secured within the stem 30 below the lower end 72 of the flow tube 70 is a flow seat member 82 which cooperates with the moveable flow tube to restrict the entry of water from the housing inlet port 62 to the nozzle 34. In this instance, the flow seat member 82 is generally cup shaped in appearance, and has a closed bottom wall 84 from which upwardly project support posts 86, herein three in number as seen in FIG. 5, extending to an enlarged diameter ring portion 88 dimensioned to be received within the inside of the stem 30 and to surround the lower end portions of the flow tube 70. Formed arcuately between the posts 86 are flow openings 90 bounded on the bottom by the bottom wall 84 and on the top by the ring portion 88, and through which water can pass from the inlet port 62 into the flow tube 70 at its lower end 72. The flow seat 82 is secured within the stem 30 herein by an outwardly projecting circumferential bead or flange 92 received within a corresponding circumferential recess 94 formed about the inside of the stem.

To seal the flow seat 82 with respect to the stem 30, an outwardly open groove 94 is formed about the upper end of the ring portion 88, and an O-ring seal 96 is disposed within the groove in sealing relation with the inside of the stem. A second O-ring seal 98 is disposed in a recess 100 formed about the inside surface of the ring portion 88, and which slideably and sealingly engages the outer wall of the flow tube 70 above its lower end 72. Herein, a retainer ring 102 having an "L" shaped vertical cross-section is secured over the upper end of the ring portions 88 to serve as a retainer for the upper surface of the second O-ring 98.

The retainer 102 also functions as support for the lower end of a compression control spring 104 disposed within the stem 30 and surrounding the flow tube 70, the upper end of the control spring seating against a downwardly facing shoulder 106 of the flange 76. The control spring 104 operates to control movement of the flow tube 70 with respect to the stem 30 in response to water pressure within the stem, as will be discussed in more detail below.

As a result of the two O-ring seals 96 and 98 supported by the flow seat 82, and the O-ring seal 78 supported by the flange 76 adjacent the upper end 74 of the flow tube 70, a fluid tight annular chamber 108 is formed between the outer surface of the flow tube and the inner surface of the stem 30, and within which the control spring 104 is disposed. To vent the chamber 108, a vent port 110 is formed through the wall of the stem 30 between the seals 96, 98 and 78, and which communicates with the inside of the housing 14. It will be noted that when the stem 30 is fully extended, the vent port 110 will be above the cap 22, thereby providing to vent to atmosphere for the chamber 108 during spraying operations of the sprinkler 12.

The pressure regulator 10 operates to control the pressure of water supplied to the nozzle 34 by controlling movement by the flow tube 70 against the bias of the control spring 104 in response to the backpressure of water acting at the upper end 74 on the down stream side of the pressure regulator within the stem 30. As water under pressure is supplied to the nozzle 34 through the stem 30, back pressure upstream of the nozzle builds due to nozzle constriction. Back pressure up stream of the nozzle 34 acts against the unsealed upper face 107 of the flange 76 of the flow tube 70 and against the basis of the control spring 104, the lower face 106 being exposed to atmospheric pressure within the chamber 108 and providing a reference pressure for the flow tube. Advantageously, the area of the upwardly facing surface 107 of the flow tube 70 is formed to have a larger area than the downwardly facing lower end 72 so that the back pressure on the upper face of the flow tube acts over a larger area than the pressure of the water entering the lower end, thereby creating a force differential tending to urge the flow tube downwardly against the bias of the control spring 104.

As seen in FIGS. 2 and 3, the bottom wall 84 of the flow seat 82 is formed to have an upwardly facing horizontal surface 112 which is generally circular in cross section and of a diameter somewhat larger than the diameter of the lower end 72 of the flow tube 70. With this arangement, water flowing into the housing inlet port 62 will be directed through the vertically extending recesses 58 of the control valve 54 and into the lower end of the stem 30. Water then flows through water flow opening 90 formed between the support posts 86 of the flow seat 82 and into the flow tube 70. By controlling the space between the lower end 72 of the flow tube 70 and the upwardly facing surface 112 of the bottom wall 84 of the flow seat 82, the flow of water from the housing inlet port 62 to the nozzle 34 can be controlled.

Accordingly, as the pressure of the water at the nozzle 34 increases above the predetermined desire level, back pressure operates on the upper face 107 of the flow tube 70 to move the flow tube downwardly against the bias of the control spring 104, thereby reducing the flow space between the bottom wall 84 of the flow seat 82 and the lower end 72 of the flow tube and reducing the water flow admitted into the flow tube. this reduction, in turn, reduces the back pressure on the upper end 74 of the flow tube 70 permitting the flow tube to rise within the stem 30 until an equilibrium position is reached where the back pressure acting on the upper end of the flow tube balances the force exerted by the control spring 104.

In one exemplary preferred embodiment of the present invention, the force of the control spring 104 was selected such that an equilibrium position for the flow tube 70 was reached when the pressure at the nozzle 34 reached 30 p.s.i. With this condition, the pressure of water at the nozzle 34 was maintained at a substantially constant 30 p.s.i. over a wide range of inlet water pressures above the desired 30 p.s.i. operating pressure. Thus, by proper selection of the control spring 104 and the area differential between the area of the lower end 72 and the area of the upper face 107 of the flow tube 70, a constant pressure at the nozzle 34 can be maintained since the flow tube will move to its equilibrium position within the stem 30 regardless of the pressure of the water supplied to the sprinkler 12.

It should be noted that at the conclusion of an operation irrigation cycle, as water supply pressure is reduced to a level below that necessary to overcome the pop-up spring 46, the stem 30 will retract into the housing 14 and the control valve 54 will close the inlet port 62, thereby trapping water within the housing. During the time which the sprinkler 12 lays dormant between uses, which can be several days or more, particulate material such as dirt, sand, small particles, and the like carried by or entrained in the water may settle out and fall toward the bottom of the sprinkler. In accordance with the present invention, means herein, a grit protector shroud 68, is provided to prevent such particulate material from accumulating around the upper seal 78 and the upper face 107 of the flow tube 70. Use of the grit protector 68 enables the pressure regulator 10 to be used with the pop-up sprinkler 12 even when operated in extremely sandy soil conditions such as those found in Florida and other areas having high concentrations of particulate matter in the irrigation water supplies.

As can best be seen in FIGS. 3 and 4, the grip protector 68, which preferably is made of molded plastic or other material which will not deteriorate with use, is generally funnel shaped in cross-section and includes an enlarged radial flange 114 at its open upper end, and a downwardly and radially inwardly directed tubular body 116 terminating in an open lower end 118. The grit protector 68 is stationarily mounted to the stem 30 by a circumferential groove 120 formed around the inside of the stem, and which is dimensioned to frictionally receive the outer periphery of the flange 114. Elongated internal ribs 122 are herein formed in the upper end portion of the stem 30 and which function to prevent the grit protector 68 from being moved upwardly from the groove 120, the ribs having flat horizontal bottom ends which abut the upper face of the flange 114.

Preferably, the length of the body 116 of the grit protector 68 is such that the lower end 118 will extend into the upper end 74 of the flow tube 70 when the flow tube is in its lower most position with the lower end 72 abutting the horizontal surface 112. When in its fully raised position shown in FIG. 2, the upper face 107 of the flow tube 70 will abut the underside of the flange 114, the flange forming a stop to restrict upward movement of the flow tube. Since it is desirable to have water pressure communicate with the upper end 74 of the flow tube 70 when the flow tube is abutting the flange 114 such as shown in FIG. 2, the passageway through the flow tube adjacent the upper end is radially enlarged so as to surround but not engage the outer surface of the grit protector body 116. To insure that no water tight seal is formed when the upper face 107 of the flow tube 70 engages the flange 114, a downwardly directed rib (not shown) can be formed in the lower face of the flange and which prevents the upper face 107 of the flow tube from sealingly engaging the flange 114.

The grit protector 68 acts to prevent particulate matter from accumulating around the seal 78 by operating as a funnel to direct any particulate material that settles out of the water captured within the sprinkler 12 when not in use downwardly into the flow tube 70 below the upper end 74. This prevents the accumulation of grit and dirt around the seal 78 which could restrict or stop free movement of the flow tube 70 when the sprinkler 12 is in operation. It has been found that when pop-up sprinklers 12 are used in particularly sandy soil areas, the grit protector 68 effectively prevents blockage of movement of the flow tube 70, while attempts to use the pressure regulator 110 without such a grit protector have resulted in the flow tube becoming inoperative after only a very short period of sprinkler use.

Thus, the present invention provides a means 68 for protecting the pressure regulator 10 within a pop-up stem 30 from becoming clogged or jammed by particulate water settling out of the irrigation water trapped within the sprinkler 12 after use. The grit protector 68 is simple in design and economical to manufacture, yet is highly reliable and effective in use for protecting the pressure regulator 10 against clogging and jamming.

While a particular form of the invention has been illustrated and described, it will be apparent the various modifications can be made without departing from the spirit and scope of the invention.

We claim:

1. In a pop-up sprinkler of the type including a tubular pop-up stem mounted within a housing for movement between an extended, operative position and a retracted, inoperative position, and having a pressure regulator mounted within the stem, the pressure regulator including a flow tube mounted for limited movement within the stem and having an open upper end and a lower end disposed adjacent a flow seat, the improvement comprising:

means disposed within said stem above said upper end of said flow tube for deflecting and directing particulate material downwardly from said stem into said flow tube when said stem is in said inoperative position.

2. The improvement as set forth in claim 1 wherein said means comprises a tubular funnel stationarily mounted within said stem and projecting downwardly into said open upper end of said tube.

3. The improvement as set forth in claim 2 wherein said tubular funnel is made of molded plastic.

4. The improvement as set forth in claim 2 wherein said tubular funnel includes an enlarged diameter open upper end converging downwardly to a smaller diameter lower end disposed within said flow tube.

5. The improvement as set forth in claim 4 wherein said tubular funnel is friction fit within said stem adjacent said enlarged diameter open upper end.

6. In combination with a pop-up sprinkler having a tubular stem mounted within a housing for reciprocation between an extended, operative position and a retracted, inoperative position disposed within the housing, a tubular pressure regulator mounted within said stem, said pressure regulator including a flow seat stationarily disposed within a lower portion of said stem and a hollow flow tube mounted for limited reciprocation within said stem above said seat, said flow tube having an upper end and a lower end; and a tubular grit protector stationarily mounted wtihin said stem above said flow tube for preventing the accumulation of particulate material adjacent said upper end of said flow tube when said stem is in said retracted, inoperative position.

7. The combination as set forth in claim 6 wherein said grit protector has a lower end portion which projects downwardly into said upper end of said flow tube.

8. The combination as set forth in claim 7 wherein said grit protector is molded plastic and has an enlarged diameter open upper end converging downwardly to an open lower end of smaller diameter.

9. The combination as set forth in claim 6 wherein said flow tube includes an O-ring seal secured about its upper end and engaging said stem, said seal supporting said flow tube within said stem and sealing between said flow tube and said stem, said grit protector preventing the accumulation of particulate material around said seal.

10. The combination as set forth in claim 9 wherein said grit protector has a relatively large diameter upper end secured to said stem and having a passageway therethrough converging downwardly to a relatively smaller diameter lower end disposed within said upper end of said flow tube, said grip protector directing particulate material downwardly through said passageway from said stem into said flow tube below said seal when said stem is in said retracted, inoperative position.

* * * * *